US010573133B2

(12) United States Patent
Sullivan

(10) Patent No.: US 10,573,133 B2
(45) Date of Patent: Feb. 25, 2020

(54) ATM/VENDING MACHINE ARMOR

(71) Applicant: Farrish B. Sullivan, Roswell, GA (US)

(72) Inventor: Farrish B. Sullivan, Roswell, GA (US)

( * ) Notice: Subject to any disclaimer, the term of this patent is extended or adjusted under 35 U.S.C. 154(b) by 0 days.

(21) Appl. No.: 15/899,161

(22) Filed: Feb. 19, 2018

(65) Prior Publication Data

US 2018/0195335 A1 Jul. 12, 2018

Related U.S. Application Data

(62) Division of application No. 15/222,187, filed on Jul. 28, 2016.

(51) Int. Cl.
*G07F 19/00* (2006.01)
*G07F 9/10* (2006.01)

(52) U.S. Cl.
CPC ..... *G07F 19/205* (2013.01); *G07F 9/10* (2013.01)

(58) Field of Classification Search
CPC ..... G06K 7/00; B65H 31/26; E05G 1/024; E05G 1/00; E05G 1/26; G07F 9/10; G07F 13/205
USPC ..... 221/99; 248/636
See application file for complete search history.

(56) References Cited

U.S. PATENT DOCUMENTS 6,470,634 B1 * 10/2002 Bloom, Sr. ..... E06B 7/28 248/345.1
7,900,683 B2 * 3/2011 DeCola ..... E06B 5/11 160/209
9,611,121 B2 * 4/2017 Tavares De Pinho ..... G07F 19/205
2006/0060114 A1 * 3/2006 Walker ..... E05G 1/00 109/67
2008/0093121 A1 * 4/2008 Webb ..... H02G 1/00 174/502
2009/0314921 A1 * 12/2009 Gould ..... E05G 1/02 248/636
2013/0055933 A1 3/2013 Markman
2013/0183116 A1 * 7/2013 Lenz, Jr. ..... B60P 7/0815 410/144
2014/0151520 A1 * 6/2014 Cato, Jr. ..... G07F 19/205 248/316.1
2018/0030773 A1 * 2/2018 Sullivan ..... G07F 19/205

FOREIGN PATENT DOCUMENTS

WO WO8503324 8/1985

* cited by examiner

*Primary Examiner* — Rakesh Kumar
(74) *Attorney, Agent, or Firm* — Laurence P. Colton; Carlos Julio Salas Martinez; Smith Tempel Blaha LLC

(57) ABSTRACT

Armoring for a light weight sheet metal enclosure of a vending machine is provided utilizing base plates on mounting bolts passing through the floor in combination, optionally, with L shaped internal wall and floor reinforcements which can mate with external reinforcing plates, sub-flooring reinforcements and vending tray armor, all of which can be combined in different manners to meet the needs of a specific machine.

2 Claims, 6 Drawing Sheets

ATM/VENDING MACHINE ARMOR

This application is a divisional application of pending U.S. patent application Ser. No. 15/222,187 entitled ATM/VENDING MACHINE ARMOR filed Jul. 28, 2016.

FIELD OF INVENTION

The present disclosure generally relates to systems, kits, and methods for installing armor that protects vending machines, and more particularly relates to pieces of adaptable armor that provide efficient protection for ATMs and other vending machines, and associated kits and methods for forming and installing such pieces of armor.

BACKGROUND

Manufacturers of ATMs typically offer two main options: choose from a heavy, strong, secure unit that is expensive or an inexpensive unit that is constructed of thinner sheet metal using cost-saving tactics such as inadequate welds.

For inexpensive ATMs and other vending machines already installed in the field, their owners face a similar choice: to leave the unit as it is or to add an expensive, armored cabinet that enshrouds the entire unit in order to protect a handful of key weak points against attack.

Given that ATMs are a ready target for theft and are often exposed to attack using vehicles and other tools, there is need in the art for improvements in vending machine armor that are affordable and effective for protecting ATMs made with thinner sheet metal and weak welding.

SUMMARY

A vending machine armor system, or a kit for installing the same, alleviates the cost of the expensive armor cabinet by providing an inexpensive product for reinforcing the weakest areas of the light weight ATM's and vending machines. The kit may be as simple as a plurality of reinforcing members designed to reinforce the area around the ATM anchor bolts or as complex as a combination of floor and wall reinforcement and cash tray reinforcements.

Other systems, devices, methods, features, and advantages of the disclosed product and methods for forming and installing pieces of a vending machine armor system will be apparent or will become apparent to one with skill in the art upon examination of the following figures and detailed description. All such additional systems, devices, methods, features, and advantages are intended to be included within the description and to be protected by the accompanying claims.

BRIEF DESCRIPTION OF THE DRAWINGS

Referring to the drawings which are appended hereto and which form a portion of this disclosure, it may be seen that.

Corresponding reference numerals designate corresponding parts throughout the figures, and components in the figures are not necessarily to scale.

DETAILED DESCRIPTION

Figure 1:
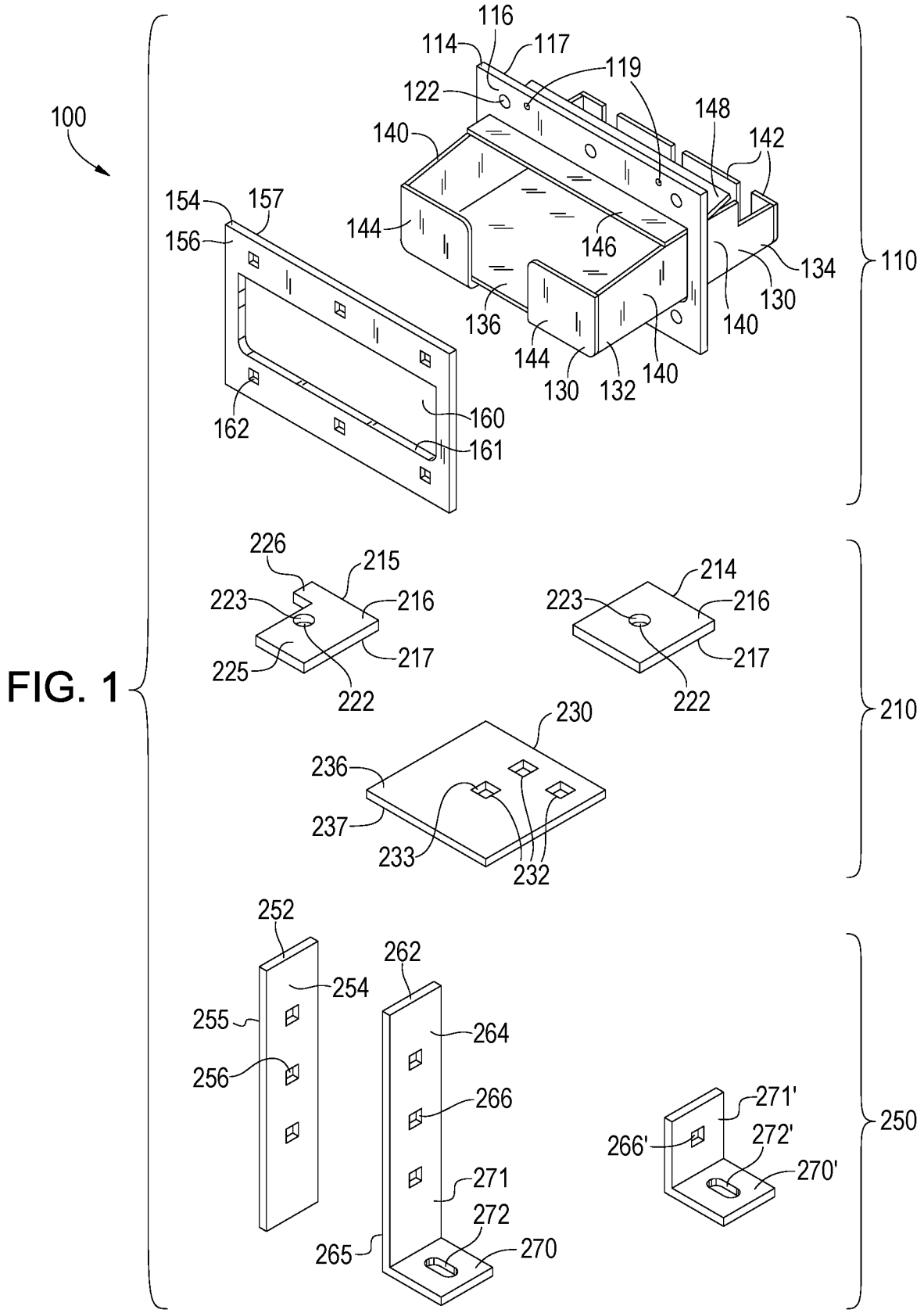
FIG. 1 is perspective view of components of my improved vending machine armor system.

It will be appreciated that the drawings are provided for illustrative purposes and that the invention is not limited to the illustrated embodiment. For clarity and in order to emphasize certain features, not all of the drawings depict all of the features that might be included with the depicted embodiment. The invention also encompasses embodiments that combine features illustrated in multiple different drawings; embodiments that omit, modify, or replace some of the features depicted; and embodiments that include features not illustrated in the drawings. Therefore, it should be understood that there is no restrictive one-to-one correspondence between any given embodiment of the invention and any of the drawings.

In describing preferred and alternate embodiments of the technology described herein, specific terminology is employed for the sake of clarity. The technology described herein, however, is not intended to be limited to the specific terminology so selected, and it is to be understood that each specific element includes all technical equivalents that operate in a similar manner to accomplish similar functions.

Described below are embodiments of armor designed to address the two most common fail points on ATMs, the cash tray and the base, including the welds that attach the base of the ATM to the walls. Standard cash trays can crumple, exposing the door of the ATM to further attack that may rend the sheet metal at the cash tray opening. Similarly, force exerted on thin sheet metal walls may cause stretching and tearing, premature breaking of welds, and ripping the base away from its anchoring system.

As seen in FIG. 1, improvements of the present vending machine armor system 100 comprise several components that may be utilized separately or in conjunction with one another, including vending tray armor 110, floor armor 210, and wall armor 250. These components are intended to reinforce the weaknesses found in conventional installations of ATMs and other vending machines. The structure of the parts and their functionality are designed for affordable, "universal fit" and allow for adaptation depending upon the construction of specific ATMs. We will first discuss improvements of the floor armor 210 and later return to discussion of the vending tray armor 110.

Figure 2:
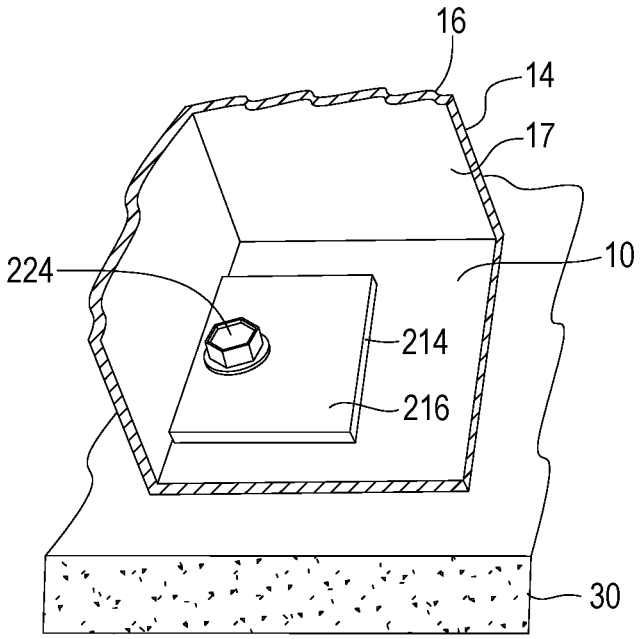
FIG. 2 is a perspective view of a reinforcing member secured through a vending machine floor to a concrete floor.
Figure 3:
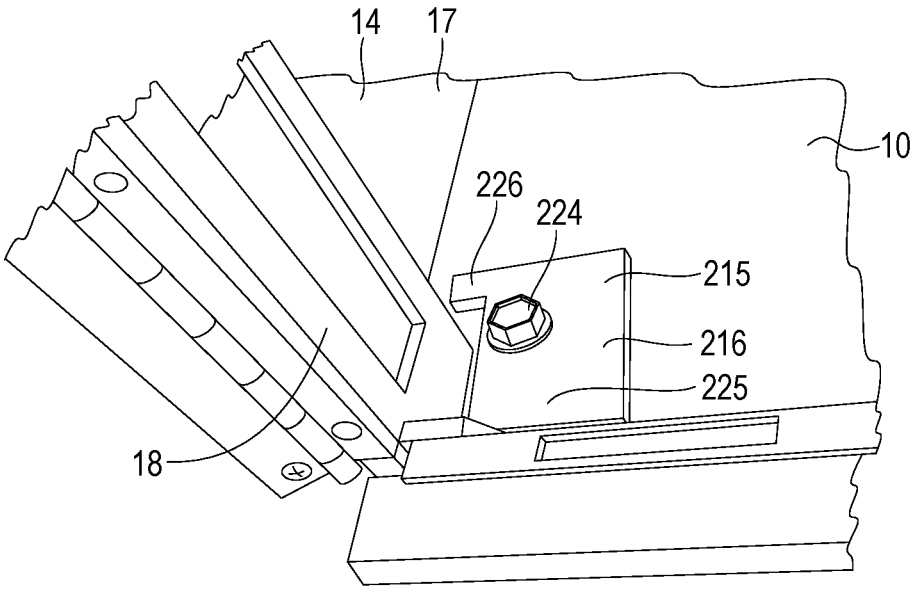
FIG. 3 is a perspective view of an L-shaped reinforcing member secured around a door hinge bar and through a vending machine floor.

FIGS. 2 and 3 illustrate reinforcing members 214 and 215 secured by a bolt 224 through the sheet metal floor 10 of a vending machine or ATM and into an underlying floor 30, in this case a concrete slab. An ATM typically has sheet metal walls 14 having an exterior surface 16 and an interior surface 17, and the intersections of the sheet metal walls 14 and floor 10 often feature welds. An installer's first thought may be to use larger, heavier grade bolts to strengthen the base of an ATM; however, that plan fails as the base will stretch and rip apart at the anchor points. Instead, reinforcing members 214 and 215 are used to increase the durability of the sheet metal floor 10 by better distributing the force of attack. Reinforcing members 214 and 215 are designed to be used with Grade 5 wedge bolts for superior performance in concrete and increased torque during installation.

In a preferred embodiment, reinforcing member 214 is formed from an approximately 3"×3" plate of ¼" steel having at least one 11/16" aperture 222 at its center, the plate then having ¼" trimmed from one edge so that the final size is approximately 2¾"×3", with the aperture 222 off center. This design allows an installer to place the reinforcing member 214 farther into a corner and closer to the walls 14 of the ATM. Alternatively, the reinforcing member 214 may have more than one aperture 222 and/or utilize an aperture 222 that is centered or placed in another position to accomplish its function. The reinforcing member 214 is not limited to the above dimensions. Further, one or more of the edges of the reinforcing member 214 may be curved or have additional angles, but the primary function is to maximize contact with the sheet metal floor 10 while keeping material weight and cost in mind.

The L-shaped reinforcing member 215 of FIG. 3 differs from the reinforcing member 214 of FIG. 2 as it is notched to fit around an ATM's door's internal hinge bar 18 in order to provide maximum support for the sheet metal wall 14 on which the hinge bar 18 is installed. After removing a ⅝"×2⅜" notch from a reinforcing member 215, a resultant L-shaped reinforcing member 215 may have a bottom leg 225 with a 2⅛" dimension and an upper leg 226 with a ⅝" dimension. The latter nestles around the hinge bar 18. The L-shaped reinforcing member 215 is not limited to the above dimensions, but must be measured and cut to fit within an ATM.

Figure 4:
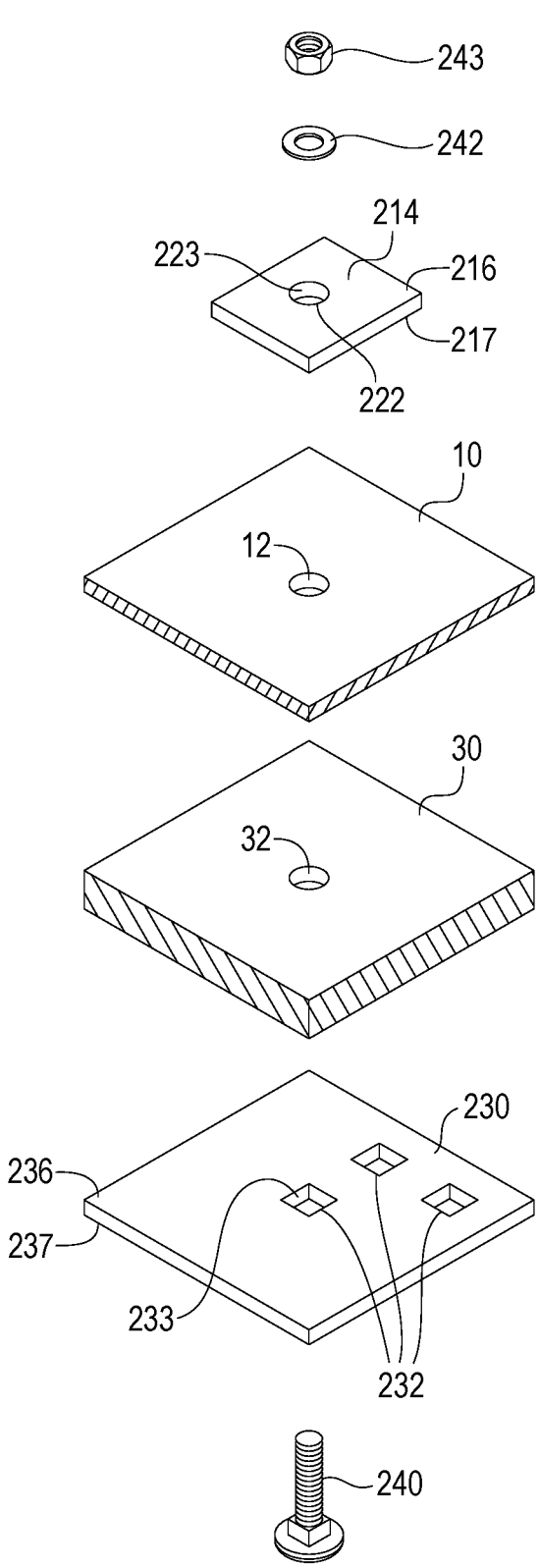
FIG. 4 is an exploded view of a reinforcing member as secured to a wooden floor.

In certain instances, an ATM or vending machine may be installed on an underlying floor 30 that is wooden or of another material that may be accessed from below. As shown in FIG. 4, a complementary reinforcing plate 230 may be placed under the floor 30 to provide resistance to pull-out. The reinforcing plate 230 has at least one aperture 232, preferably square in order to accept a Grade 5 carriage bolt 240, and preferably at least three apertures 232 spaced about the surfaces 236/237 of the reinforcing plate 230 to allow the installer to navigate around joists, pipes, wires, and other obstacles. The reinforcing plate 230 may be approximately 4"×4" with a top surface 236 and a bottom surface 237, but the reinforcing plate 230 may be of other shapes and dimensions that provide similar functionality.

In use, a carriage bolt 240 is inserted through apertures 232/32/12/222 in the reinforcing plate 230, underlying floor 30, ATM sheet metal floor 10, and reinforcing member 214, respectively, and secured by a lock washer 242 and nut 243. The carriage bolt 240 resists removal due to its low profile head and square interface with the reinforcing plate 230. If a thief tries to remove the ATM by force, the bottom surface 217 of the reinforcing member 214 spreads the force exerted upon the ATM's sheet metal floor 10. In similar fashion, the upper surface 236 of reinforcing member 230 spreads the force underneath supporting floor 30.

Figure 5:
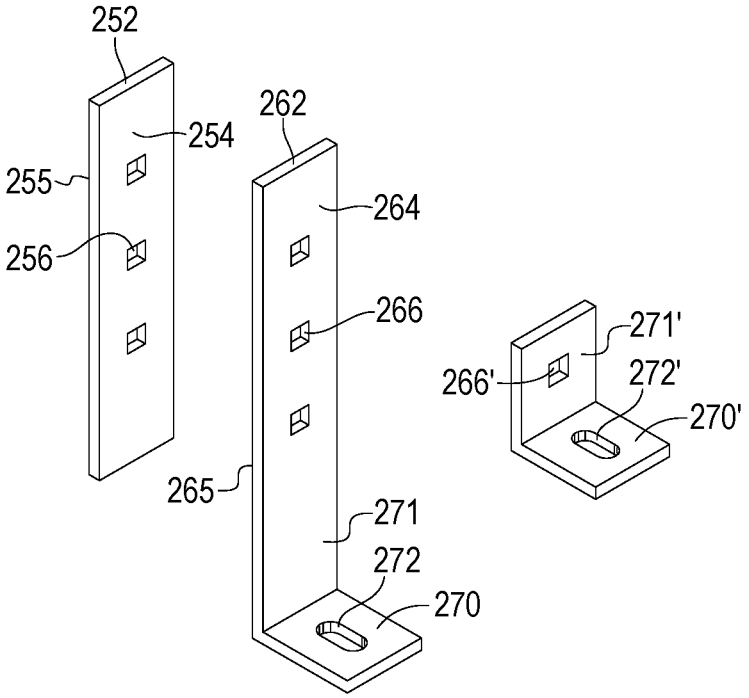
FIG. 5 is a perspective view of an angle bracket and cooperating reinforcing member.
Figure 6:
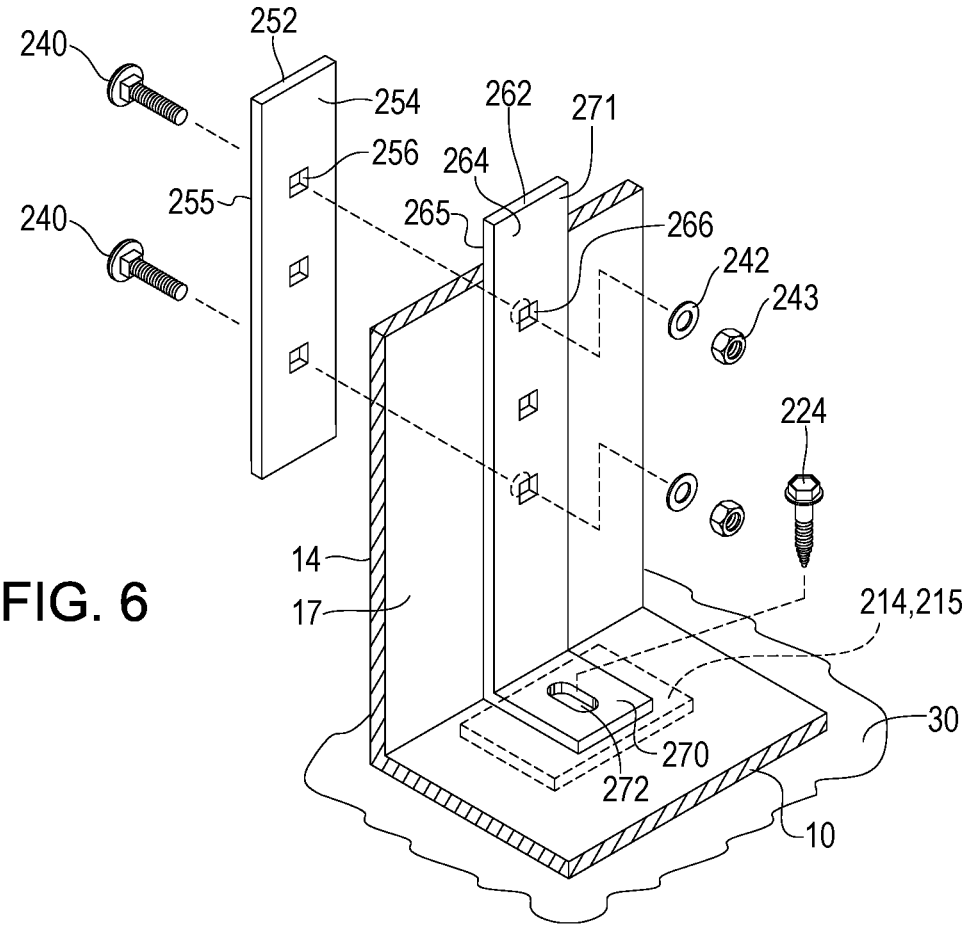
FIG. 6 is an exploded view of the angle bracket of FIG. 5 as installed inside a vending machine.

Turning our attention to FIGS. 5 and 6, we see a 3" wide wall-reinforcing angle bracket 262 and cooperating wall-reinforcing member 252 formed of ¼" steel and designed to help maintain the integrity of the intersections of the sheet metal wall 14 and floor 10. The longer arm 271 of the angle bracket 262 may be about 12" in height and preferably has three ½" square apertures 266 centered about 1½", 6", and 10½" from the bend in the bracket 262, but the angle bracket 262 may have more or fewer than three apertures 266 that may also be placed differently on the bracket 262. The shorter arm 270 may be about 3" in length and may have at least one 9/16"×1¼" slot aperture 272 centered on that arm 270, with the slot aperture 272 running perpendicular to the longer arm 271. Wall-reinforcing member 252 preferably has dimensions similar to the angle bracket's 262 longer arm 271 and has three square punched apertures 256, but may have more or fewer than three apertures. Alternatively, the 3" wide angle bracket may have two short arms, with at least one aperture 266' centered in one 3" tall arm 271' and at least one slot aperture 272' in the other 3" arm 270' as described above. A matching wall-reinforcing member, not shown, would also be cooperatively positioned relative to this wall-reinforcing member.

In use, holes are drilled in the ATM's sheet metal wall 14 to match the placement of the angle bracket 262 inside the ATM with the slotted arm 270 oriented horizontally. Carriage bolts 240 are inserted through apertures 256 and 266 in the cooperating wall-reinforcing member 252 and angle bracket 262, respectively, and secured against opposing faces 255 and 264 by a lock washer 242 and nut 243. Alignment of angle bracket 262 is facilitated by the slot 272 in the angle bracket 262. As described previously, a wedge bolt 224 (or carriage bolt 240 with reinforcing plate 230 under a wooden floor 30 having a bolt hole 32 formed therein) may be used for mounting to the underlying floor 30. When force is exerted on the sheet metal walls 14, the angle bracket 262 and wall-reinforcing member 252 (which may be referred to as straps) grip the walls 14 between their abutting faces 254 and 265 to spread the force. By using substantially less material, with no locks or guards, than existing armors, this lighter weight design may be installed by a simple handyman, and the materials do not interfere with appearance, operation, or servicing of the ATM.

One of skill in the art will recognize that the parts described thus far are not limited to the exact shapes and dimensions described, yet the present design impacts functionality on several fronts. The parts preferably are large enough and sturdy enough to absorb and spread the force associated with breaking into ATM machines, yet the parts also are preferably small enough and lightweight enough to fit the limited space inside the ATM and to remain affordable in terms of materials and shipping.

Figure 9:
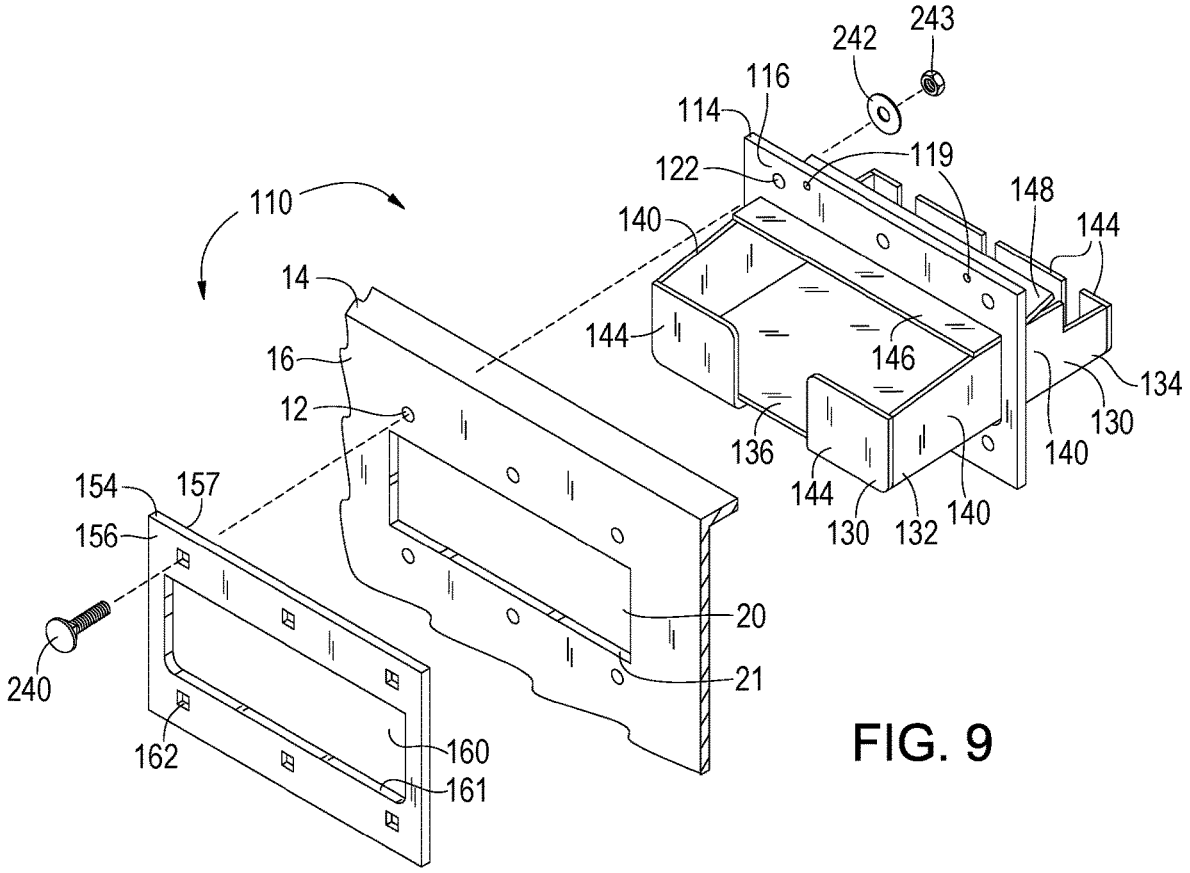
FIG. 9 is an exploded front view of the vending tray of FIG. 7.
Figure 10:
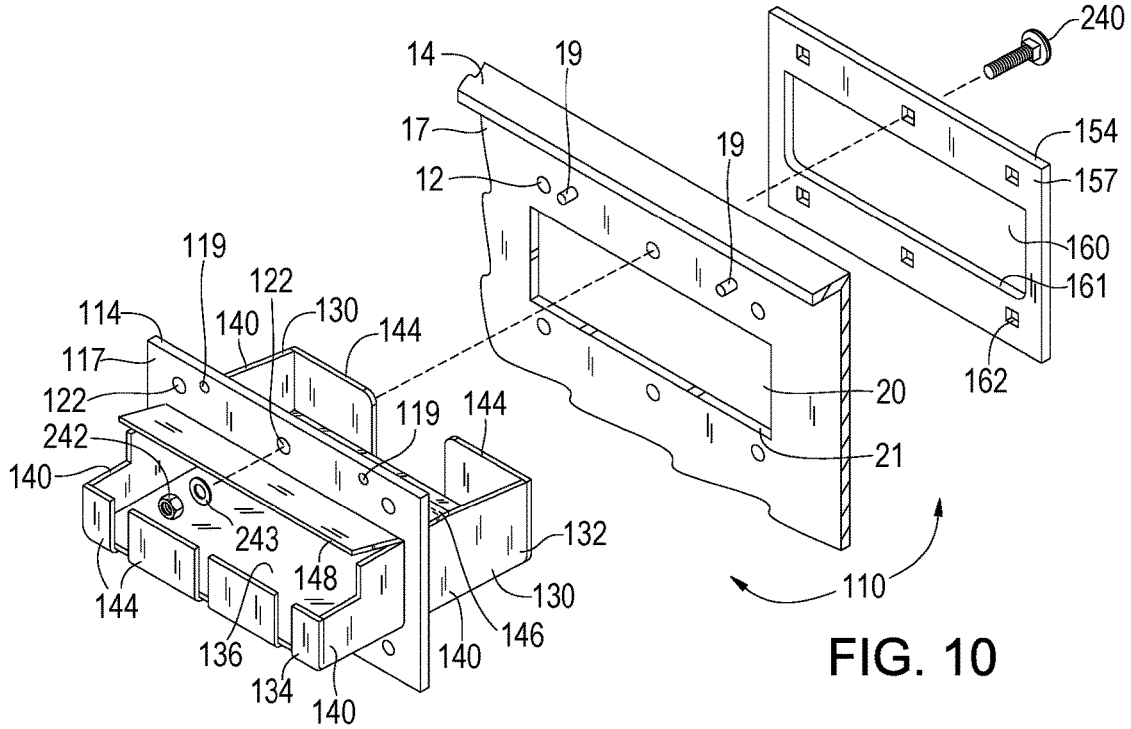
FIG. 10 is an exploded rear view of the vending tray of FIG. 7.

Returning now to the vending tray armor 110, as best seen in the exploded views of FIGS. 9 and 10, an ATM or vending machine cabinet has a steel wall 14 (which may be a door) with an exterior surface 16 and an interior surface 17 through which a tray opening 20 with inner surface 21 is formed. The tray opening 20 is a weakness during attacks of brute force, which may cause the sheet metal wall 14 to pucker and/or to give way at the corners, rending the material. The present solution is to provide a vending tray armor 110, also referred to as an armored vending tray, having a two-part mounting frame 114/154 comprising steel plates or brackets that sandwich and tightly clamp over the entire tray opening 20. An inside mounting frame 114 is attached to a cash delivery tray or vending tray 130 by welds on the back surface 117 of the inside frame 114, which may be referred to as the cash tray frame or vending tray frame. Welds are not limited to this area, but may be made in other areas that provide sufficient strength.

To install the vending tray armor 110, the original delivery tray is removed, and studs 19 from the original installation may remain on the interior surface 17. Then an outside portion 132 of the vending tray 130 is inserted from inside the vending machine cabinet through the tray opening 20, and the approximately ¼" apertures 119 in the inside mounting frame 114 allow the installer to negotiate around the existing studs 19 such that the front surface 116 of the inside mounting frame 114 may rest against the interior surface 17 of the sheet metal wall 14. A matching outside frame 154 of similar dimensions, preferably with square punched apertures 162, is placed on the exterior surface 16 of the sheet metal wall 14 opposite the inside mounting frame 114. Outside frame 154 includes an outer surface 156 and an inner surface 157 which abuts wall 14 about tray opening 20. The inner surface 161 of the outside frame opening 160 surrounds the vending tray 130.

Figure 7:
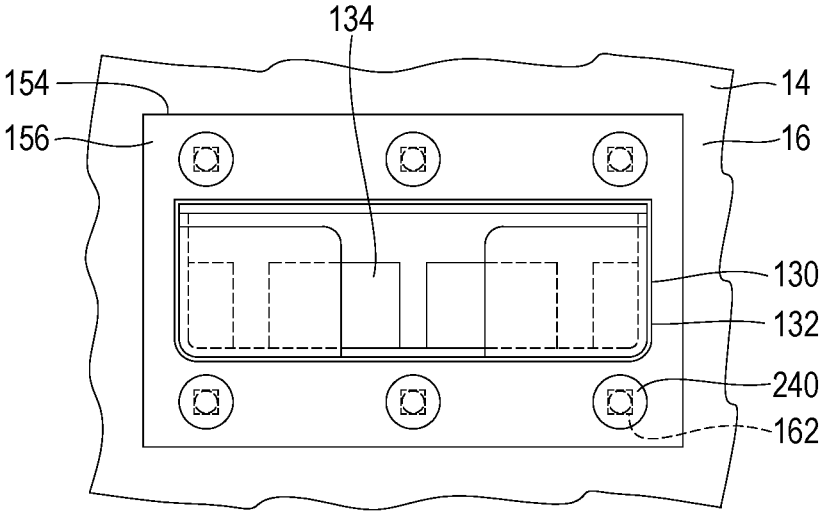
FIG. 7 is a front view of an installed armored vending tray or cash delivery tray.
Figure 8:
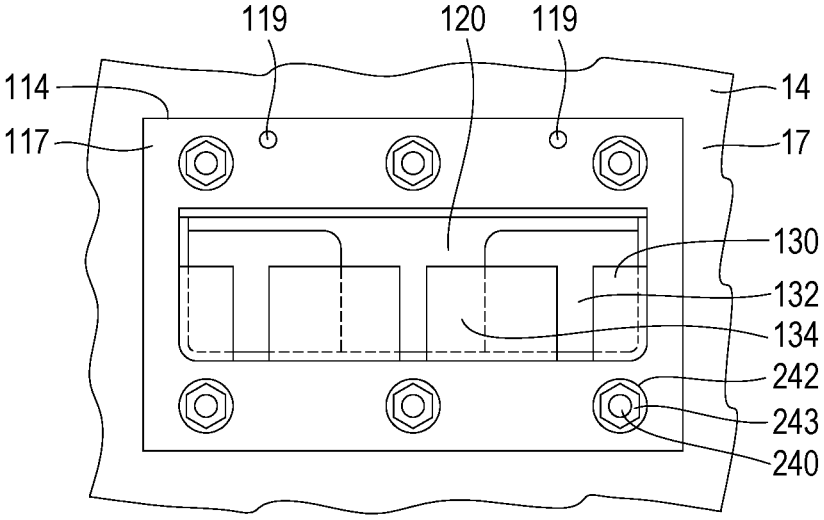
FIG. 8 is a rear view of the installed armored vending tray of FIG. 7.

FIG. 7 is a front view of the installed vending tray 130 showing the outside portion 132 projecting through the outside frame opening 160 of the outside frame 154. FIG. 8 is a rear view of the installed vending tray 130 showing the inside portion 134 projecting through the inside frame opening 120 of the inside frame 154. In a preferred embodiment, six carriage bolts 240 [or 190] are inserted through the outside frame 154, the sheet metal wall 14, and the inside mounting frame 114 via apertures 162/12/122, respectively, and secured by a lock washer 242 and nut 243. Apertures 162/122 may be located about the four corners and center of the frame openings 160/120, with three on top and three on the bottom, or otherwise positioned to resist damage during attack. The frames 114/154 are not limited to six apertures, but may have more or fewer apertures and corresponding connectors, and the vending tray armor 110 is not limited to carriage bolts 240.

By employing stronger and/or heftier materials than that used for the sheet metal wall 14 and clamping the wall 14 in a two-part frame 114/154, the tray opening 20 in the ATM is dramatically reinforced against being ripped apart, whether a criminal tries to crush or extract the vending tray 130.

The cash delivery tray or vending tray 130 itself has a base 136 that measures about 4" wide by 7¾" long with walls 144/140/142 rising substantially vertically from the base 136, preferably with rounded corners in the transitions between base 136 and walls 144/140/142. Depending upon the thickness of the inside mounting frame 114, about 64% of the base 136 resides in front of the inside frame 114 and about 30% of the base 136 resides behind the inside frame 114. (Given a ¼" inside frame 114 thickness, the front portion 132 is about 2 19/32" wide and the back portion 134 is about 1 3/16" wide.) Two front wall sections 144 with a height of about 2" have a gap between them sized for a human hand to retrieve paper money from the front portion 132 of the vending tray 130, each front wall section 144 adjoining a respective side wall 140, the transition between walls 144 and 140 preferably rounded for strength. The side walls 140 are continuous and taper upward about ½" from the top of the front wall sections 144 to level out toward the inside frame 114 at about 2 15/32" high, perhaps going beyond the frame 114, then step down to the height of the back wall 142, which is lower than the front wall sections 144. The back wall 142 is discontinuous, with a series of buttresses and intervening gaps, and configured to interface with a cash dispenser (not shown).

Extending from the top of one side wall 140 to the top of the other side wall 140 is a stabilizing member 146 that strengthens the side walls 140 and reaches beyond the outside frame 154 when installed to partially block entrance to the back portion 134 of the vending tray 130. This stabilizing member 146 abuts the top of the inside frame opening 120 and may be welded thereto and/or may be one piece with a flap-like member 148 that reaches behind the inside frame 114 and angles upward to resist pull-out of the vending tray 130 from the inside frame 114. The flap-like member 148 is configured to avoid any bolts 240 and nuts 243 on the back surface 117 of the inside frame 114.

In a preferred embodiment, each frame 114/154 is formed of ¼" steel, and the perimeter or each frame 114/154 measures about 5 1/16"×9¾". Each frame opening 160/120 may be centered on its respective frame 114/154 and measure slightly larger than 2 15/32"×7¾" in order to accommodate the vending tray 130 with some clearance. The stabilizing member 146 at the top of the vending tray 130 is intended to fit within this clearance. The frame openings 160/120 may be shaped to accommodate straight or curved portions of the vending tray 130.

One of skill in the art will understand that the specific sizes and configuration described for the vending tray 130 and frames 114/154 may be altered and to some degree and perform the functionality required, provided the vending tray 130 is able to interface with a cash dispenser, output currency onto into the vending tray 130, enable a person to retrieve said currency, and to do so securely as part of a two-frame vending tray armor 110 system. The vending tray 130 and frame 114/154 components may be stamped, break formed, or cut and welded, or any combination of those and other manufacturing methods.

Materials in this specification are not limited to sheet metal, steel plate or other types of steel, but may also include carbon fiber materials, high-strength plastics, and/or a variety of composite materials that are able to fulfill the intended purposes. Additionally, reference is made to particular bolts, as well as square apertures; however, other connectors and shapes may be used to achieve the same function.

A kit for improving the security of an ATM or vending machine may include vending tray armor 110, floor armor 210, and wall armor 250, as well as connectors, tools, and instructions necessary to install the armor. Other kits may include subsets of the total vending machine armor system 100. A vending tray armor 110 kit may include and inside mounting frame 114 with vending tray 130, an outside frame 154, a gasket or other weatherization and sealing material (not shown), and an appropriate complement of carriage bolts 240 [or 190], washers 242 [or 192], and nuts 243 [or 193]. A floor armor 210 kit for installation on a concrete underlying floor 30 may include at least one reinforcing member 214, at least one L-shaped reinforcing member 215, and at least one screw 224—with a typical kit including three reinforcing members 214, one L-shaped reinforcing member 215, and four screws 224. A floor armor 210 kit for installation on a wooden underlying floor 30 may substitute carriage bolts 240 for the screws 224 of the previously described kit, along with an appropriate complement of washers 242 and nuts, and add at least one (typically four) reinforcing plates 230. A wall armor 250 kit may include at least one angle bracket 262 and at least one wall-reinforcing member 252, with appropriate connectors. A kit may include multiple sets of angle brackets 262 and wall-reinforcing members 252 of the same or different size. Other kits may be combinations of the above kits; for example, a combination of floor armor 210 plus wall armor 250.

Methods of installing and using the various armor have been described throughout this specification. It is understood that steps of installation and use may be performed in different order and that some steps may be omitted or added while achieving the same functionality.

While in the foregoing specification this invention has been described in relation to certain embodiments thereof, and many details have been put forth for the purpose of illustration, it will be apparent to those skilled in the art that the invention is susceptible to additional embodiments and that certain of the details described herein can be varied considerably without departing from the basic principles of the invention.

What I claim is:

1. A kit for armoring a lightweight vending machine or ATM machine having sheet metal walls, floor, and top, and a delivery tray extending through an opening in one of said sheet metal walls, the kit comprising:

a. tray armor removably mounted to said wall proximate said opening;

b. an armored replacement vending tray removably extended through said opening in said wall;

c. an inside mounting frame removably mounted on an inside surface of said wall and supporting said armored replacement vending tray extended through said opening in said wall; and d. a reinforcing panel removably mounted on an outside surface of said wall;

wherein said reinforcing panel has an opening therein commensurate with said opening in said wall of the vending machine;

wherein the armored replacement vending tray also is removably extended through said opening in said reinforcing panel; and wherein said inside mounting frame and said reinforcing panel are removably engaged such that said wall of the vending machine is sandwiched between said inside mounting frame and said reinforcing panel.

2. A kit as defined in claim 1, wherein said inside mounting frame and said reinforced panel surround said opening along said inside surface of said wall and said outside surface of said wall of the vending machine, respectively.

* * * * *